US010790608B2

(12) United States Patent
Blyahman et al.

(10) Patent No.: US 10,790,608 B2
(45) Date of Patent: Sep. 29, 2020

(54) APPARATUSES FOR IMPROVED CABLE-TO-BOARD CONNECTIONS

(71) Applicant: Mellanox Technologies, Ltd., Yokneam (IL)

(72) Inventors: Andrey Blyahman, Haifa (IL); Yossi Nachum, Haifa (IL); Miki Stravets, Kiryat Motzkin (IL)

(73) Assignee: MELLANOX TECHNOLOGIES, LTD., Yokneam (IL)

( * ) Notice: Subject to any disclaimer, the term of this patent is extended or adjusted under 35 U.S.C. 154(b) by 0 days.

(21) Appl. No.: 16/188,366

(22) Filed: Nov. 13, 2018

(65) Prior Publication Data

US 2020/0153164 A1 May 14, 2020

(51) Int. Cl.
*H01R 13/50* (2006.01)
*H01R 12/75* (2011.01)
(Continued)

(52) U.S. Cl.
CPC ..... *H01R 13/501* (2013.01); *H01R 12/523* (2013.01); *H01R 12/7011* (2013.01); *H01R 12/7017* (2013.01); *H01R 12/75* (2013.01); *H01R 13/5829* (2013.01); *H01R 13/639* (2013.01)

(58) Field of Classification Search
CPC .. H01R 12/79; H01R 13/5829; H01R 13/639; H01R 12/772; H01R 13/24; H01R 12/00; H01R 12/61; H01R 12/62; H01R 12/675; H01R 12/7005; H01R 12/7011; H01R 12/7076; H01R 12/721; H01R 12/722; H01R 12/771; H01R 12/774; H01R 12/777; H01R 12/778; H01R 12/82; H01R 12/88; H01R 13/501; H01R 13/502; H01R 13/506; H01R 13/582; H01R 13/5837; H01R 13/627; H01R 13/6275; H01R 13/62988; H01R 13/6595; H01R 13/73; H01R 2201/06; H01R 23/661; H01R 23/667; H01R 33/92; H05K 3/301; H05K 7/1405
See application file for complete search history.

(56) References Cited

U.S. PATENT DOCUMENTS 4,416,497 A * 11/1983 Brandsness ..... H01R 12/774 439/492
4,448,474 A * 5/1984 Melnychenko ..... H01R 12/75 439/472
(Continued)

*Primary Examiner* — Edwin A. Leon
*Assistant Examiner* — Matthew T Dzierzynski
(74) *Attorney, Agent, or Firm* — Alston & Bird LLP

(57) ABSTRACT

Apparatuses, systems, and associated methods of manufacturing are described that provide a retention clip for securing a cable connection to a printed circuit board (PCB). An example retention clip includes a bottom support member, a top support member, and a hinge element attached to the top support member and the bottom support member. The hinge element allows movement of the retention clip between a locked position and an unlocked position. The retention clip further defines an opening configured to receive one or more cable connections therethrough. In the locked position, the top support member is folded about the hinge element so as to engage the bottom support member and secure the cable connection disposed within the opening to the PCB.

20 Claims, 9 Drawing Sheets

(51) Int. Cl.

| | |
|---|---|
| ***H01R 13/639*** | (2006.01) |
| ***H01R 12/70*** | (2011.01) |
| ***H01R 13/58*** | (2006.01) |
| ***H01R 12/52*** | (2011.01) |

(56) References Cited

U.S. PATENT DOCUMENTS 5,494,451 A * 2/1996 Bowers ..... H05K 7/1405 439/328
5,980,307 A * 11/1999 Brewster ..... H01R 12/772 439/493
6,027,363 A * 2/2000 Watt ..... H01R 12/772 439/456
6,626,696 B2 * 9/2003 Kondo ..... H01R 12/772 439/467
6,761,589 B2 * 7/2004 Venditti ..... H01R 13/506 439/596
6,793,527 B2 * 9/2004 Noro ..... H01R 12/594 439/497
7,008,257 B2 * 3/2006 Zhu ..... H01R 13/5804 439/470
7,037,025 B2 * 5/2006 Takahashi ..... F16B 5/123 24/24
7,044,772 B2 * 5/2006 McCreery ..... H01R 12/675 439/493
7,629,533 B2 * 12/2009 Cole, Sr. ..... B01L 1/00 174/17.07
8,221,152 B2 * 7/2012 Tracy ..... H01R 13/5829 439/371
9,166,319 B2 * 10/2015 Gingrich, III ..... H01R 12/771
9,190,769 B2 * 11/2015 Nonen ..... H01R 13/5829
9,631,801 B2 * 4/2017 Que ..... H01R 12/88
10,205,259 B2 * 2/2019 Wang ..... H01R 12/79
10,283,950 B2 * 5/2019 Gintz ..... H02G 3/32

* cited by examiner

APPARATUSES FOR IMPROVED CABLE-TO-BOARD CONNECTIONS

TECHNOLOGICAL FIELD

Example embodiments of the present invention relate generally to cable connection systems and, more particularly, to ensuring retention of cable-to-board connectors.

BACKGROUND

Communication systems often rely on connections between components of various types in order to provide efficient data transfer. By way of example, connections between cable connectors (e.g., wired elements) and printed circuit boards (PCBs) (e.g., board elements) are often required. To provide these connections, cable-to-board, wire-to-board, and/or micro-coaxial connectors (such as CABLINE® connectors produced by I-PEX) may be used. In order to provide increased data transmission rates, increased bandwidth density, enhanced capacity, and the like in datacenters and other related communications systems, consistent connection of these cable-to-board connections is desired.

BRIEF SUMMARY

Apparatuses, systems, and associated methods are described for securing a cable connection to a printed circuit board (PCB). For example, a retention clip is provided that is configured to secure a cable connection to a printed circuit board (PCB). The retention clip may include a bottom support member and a top support member. The retention clip may further include a hinge element attached to the top support member and the bottom support member that may be configured to allow movement of the retention clip between a locked position and an unlocked position. The retention clip may also define an opening that may be configured to receive a cable connection therethrough. In the locked position, the top support member may be folded about the hinge element so as to engage the bottom support member and secure the cable connection disposed within the opening to the PCB.

In some embodiments, the bottom support member may further define one or more snap tabs extending from a first surface of the bottom support member. In such an embodiment, the one or more snap tabs may extend substantially perpendicular with respect to the bottom support member. In some cases, in the locked position, the one or more snap tabs are configured to be received by one or more corresponding cut-outs of the PCB. In other instances, the top support member further defines one or more corresponding notch features configured to, in the locked position, receive the one or more snap tabs of the bottom support member engaged therewith.

In some embodiments, in the locked position, the first surface of the bottom support member is configured to be located proximate a corresponding bottom surface of the PCB. Similarly, in some embodiments, a first surface of the top support member is configured to be located proximate a corresponding top surface of the PCB in the locked position.

In some cases, the hinge element is biased towards the unlocked position.

In other embodiments, the opening may be formed between the top support member, the bottom support member, and the hinge element.

In some embodiments, the opening may be further configured to receive two cable connections such that, in the locked position, a first cable connection is attached to a corresponding first connector supported by a top surface of the PCB and a second cable connection is attached to a corresponding second connector supported by a bottom surface of the PCB.

The above summary is provided merely for purposes of summarizing some example embodiments to provide a basic understanding of some aspects of the invention. Accordingly, it will be appreciated that the above-described embodiments are merely examples and should not be construed to narrow the scope or spirit of the invention in any way. It will be appreciated that the scope of the invention encompasses many potential embodiments in addition to those here summarized, some of which will be further described below.

BRIEF DESCRIPTION OF THE DRAWINGS

Having described certain example embodiments of the present disclosure in general terms above, reference will now be made to the accompanying drawings. The components illustrated in the figures may or may not be present in certain embodiments described herein. Some embodiments may include fewer (or more) components than those shown in the figures.

DETAILED DESCRIPTION

Overview

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. As used herein, terms such as "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances.

As discussed herein, the example embodiment may be described with reference to a micro-coaxial cable such as a CABLINE® cable and associated connector produced by I-PEX as a suitable cable connection. However, the present disclosure may be equally applicable for use with other cable-to-board connections, wire-to-board connections, or the like.

Figure 1A:
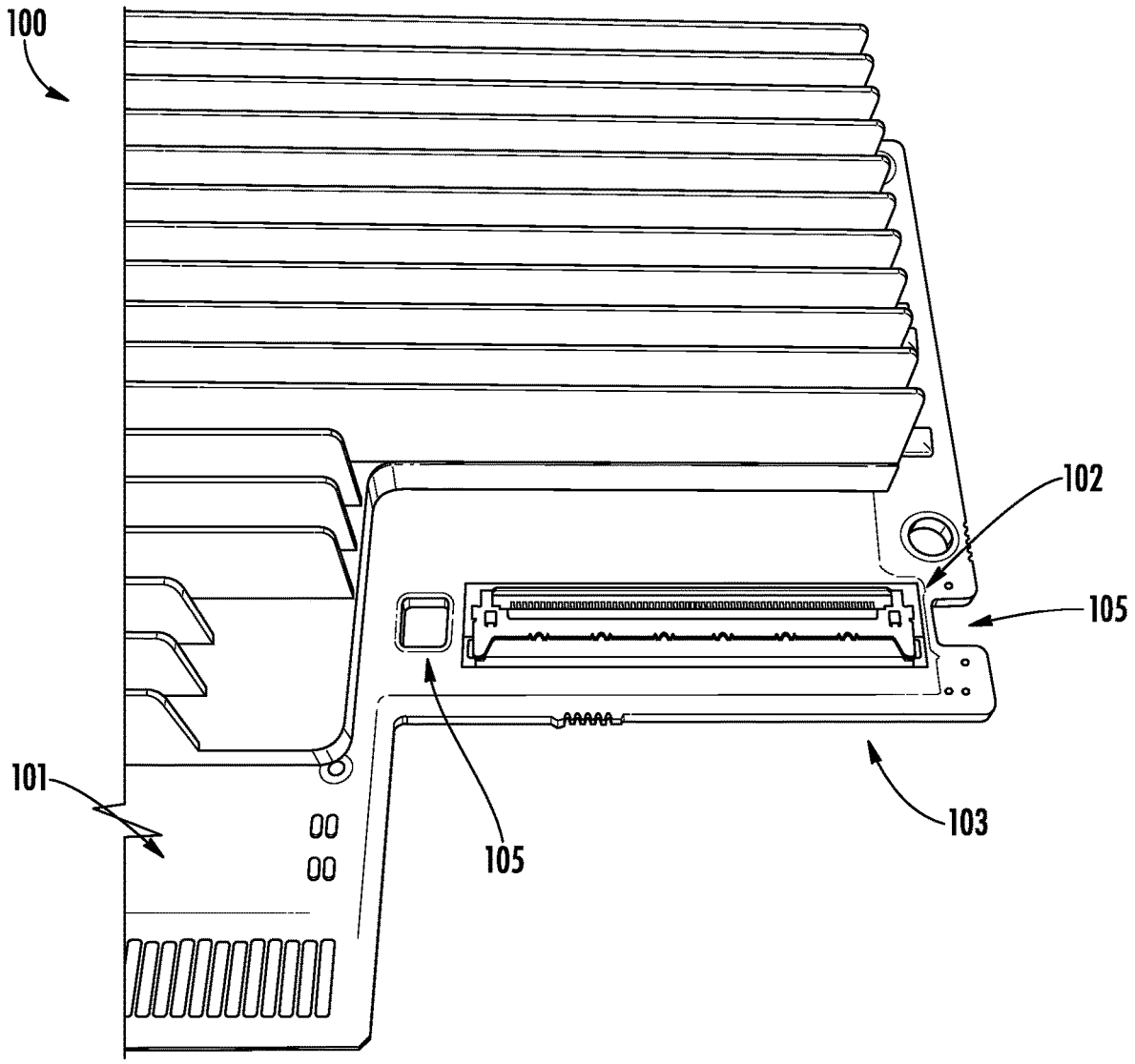
FIG. 1A is a perspective view of a printed circuit board (PCB) that includes a connector for use with some embodiments described herein.

With reference to FIG. 1A, a printed circuit board (PCB) 100 is illustrated for use with some embodiments of the present invention. The PCB 100 may include connections, electrical elements, or other features supported by or attached to a first surface 101 of the PCB 100. Similarly, the PCB 100 may also include connections, electrical elements, or other features supported by or attached to a second surface 103 of the PCB 100, opposite the first surface 101. The first surface 101 of the PCB 100 may support a first connector 102 that is configured to receive a cable connection attached thereto (e.g., cable connection 104 in FIG. 1B). As would be evident to one of ordinary skill in the art in light of the present disclosure, the first connector 102 may be a horizontal mating connector configured to receive a corresponding cable connection such that data (e.g., electrical signals) may be transferred between the cable connection and the PCB 100. Furthermore, while not illustrated in FIG. 1A, the second surface 103 of the PCB 100 may also include a second connector (not shown) for receiving a cable connection (e.g., cable connection 104 in FIG. 1B). As described hereafter with reference to FIGS. 2A-3 and FIGS. 6-7, the PCB 100 may also include one or more cut-outs 105 configured to receive corresponding elements of an example retention clip.

Figure 1B:
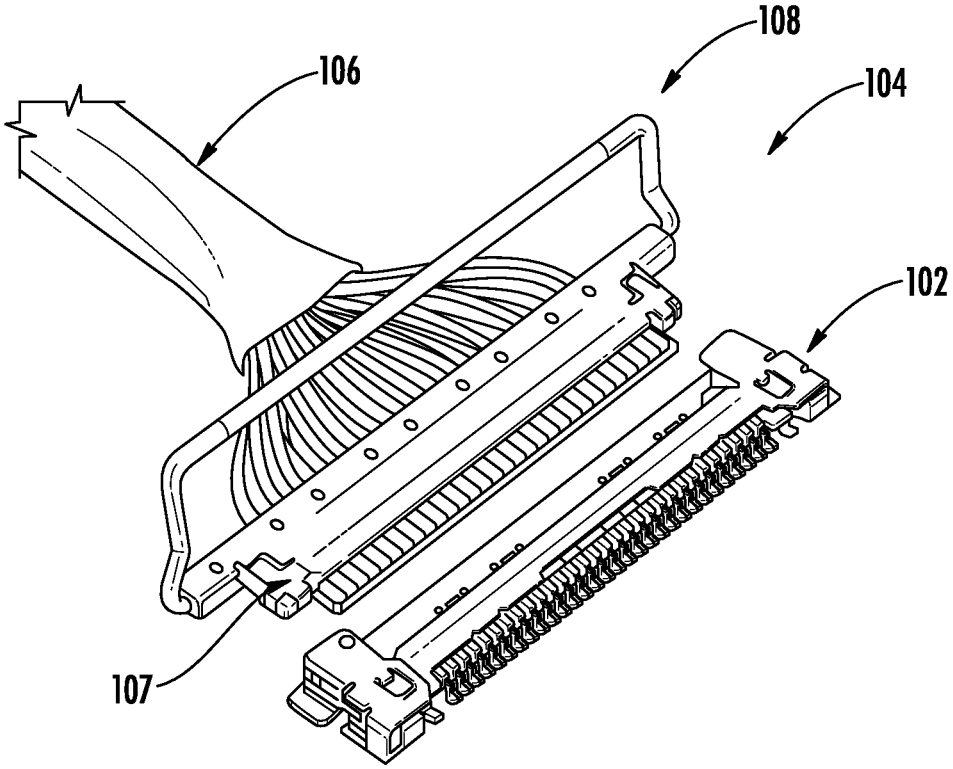
FIG. 1B PRIOR ART
FIG. 1B is a perspective view of an example cable connection configured to engage the PCB connector of FIG. 1 for use with some embodiments described herein.
Figure 1C:
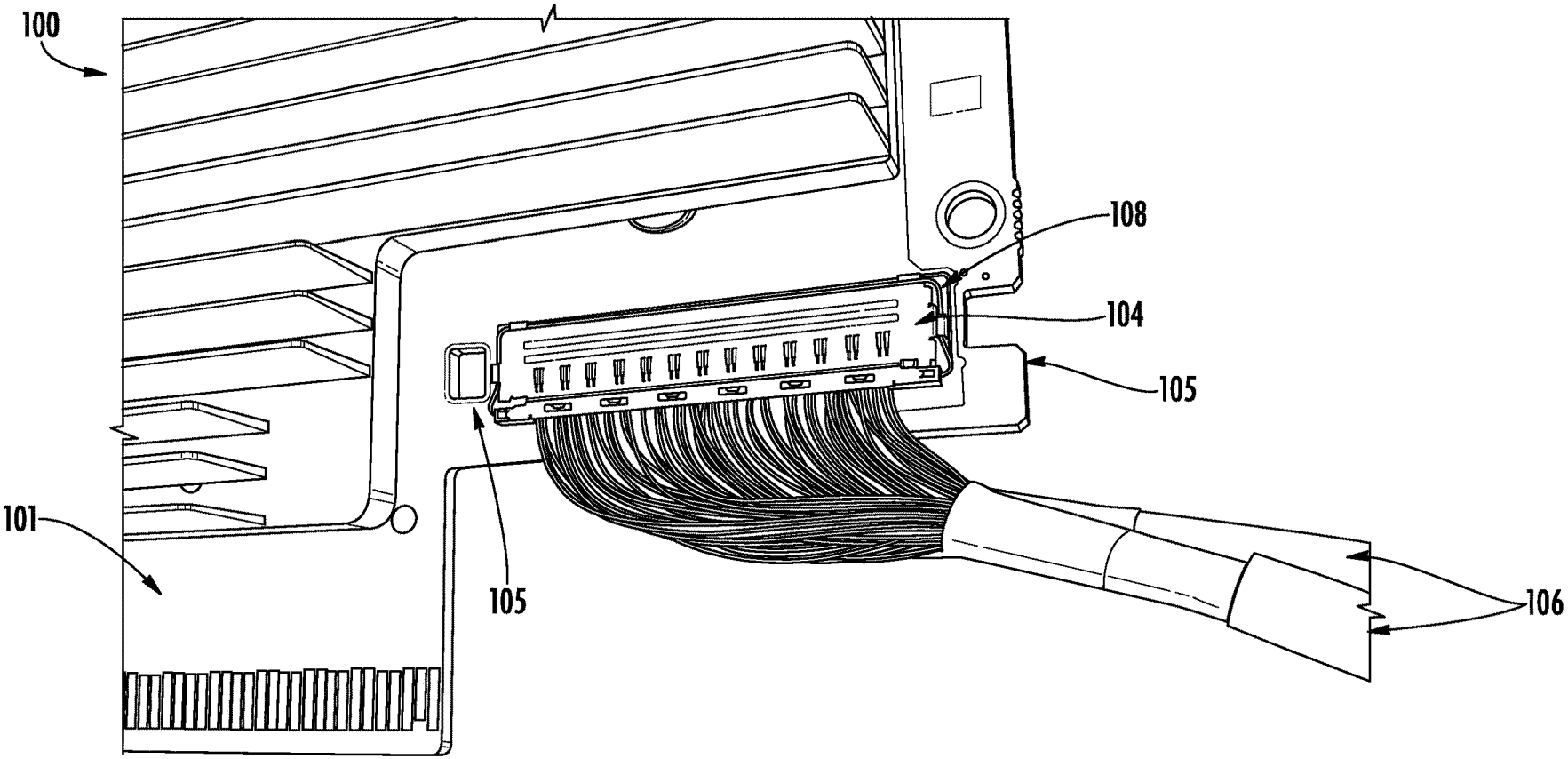
FIG. 1C is a perspective view of an example cable connection engaged with a corresponding connector of the PCB for use with some embodiments described herein.

With reference to FIG. 1B, an example cable connection (e.g., a micro-coaxial cable) configured to engage a connector 102 of the PCB 100 of FIG. 1A is illustrated. As shown, the cable connection 104 may include a cable bundle 106 that terminates at an end 107 configured to be mated with the connector 102 (shown detached from PCB 100 in FIG. 1B). In operation, this connection between the end 107 and the connector 102 may allow data to be transmitted between the PCB 100 supporting the connector 102 and electronic devices located at one or more opposite ends (not shown) of the cable bundle 106. The example cable connection 104 shown in FIGS. 1B-1C may also include a lever arm 108 that, in operation, is folded in the direction of the PCB 100 to be located adjacent the connector 102 and PCB 100. In this way, traditional features for securing cable-to-board connections (e.g., shown in FIG. 1C) only attempt to prevent movement of the first end 107 with respect to the connector 102 in a single direction. Said differently, movement of the cable connection 104 in a direction substantially perpendicular with respect to the PCB 100 supporting the connector 102 is not prevented by the lever arm 108. As would be evident to one of ordinary skill in the art in light of the present disclosure, movement of cable connections attached to PCBs is frequently experienced during operation. PCBs may be moved in the process of attaching additional connections, in response to relocating or shifting a housing for the PCB, and/or for other reasons such that disengagement of traditional cable connections and associated PCBs can be prevalent. As such, embodiments of the present invention are directed to a retention clip that secures a cable connection to a PCB so as to prevent spontaneous disengagement (and associated loss of data transmission and other inefficiencies).

Retention Clip

Figure 2A:
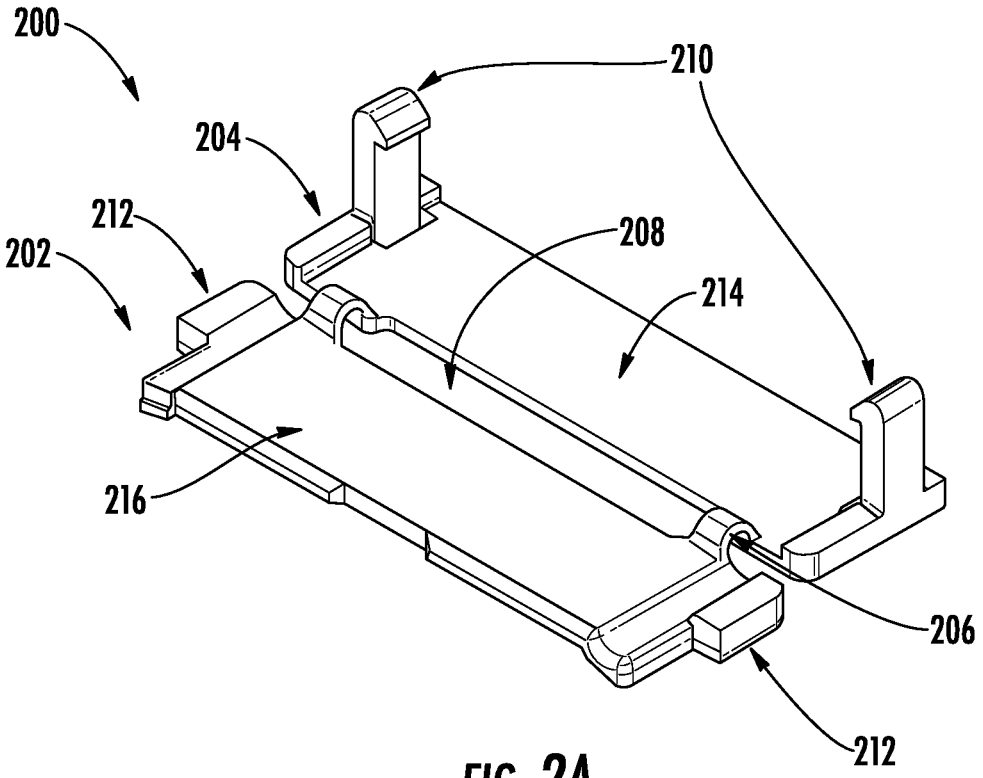
FIGS. 2A-2B are perspective views of an example retention clip in an unlocked position according to an example embodiment.
Figure 2B:
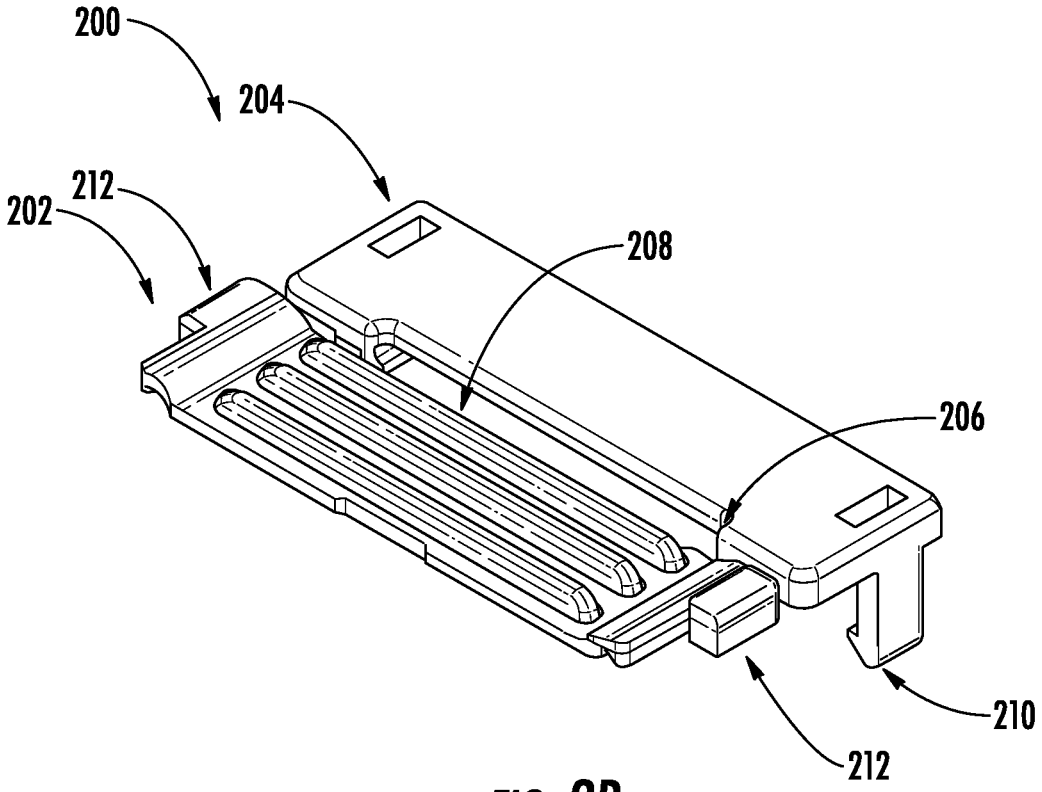
Figure 3:
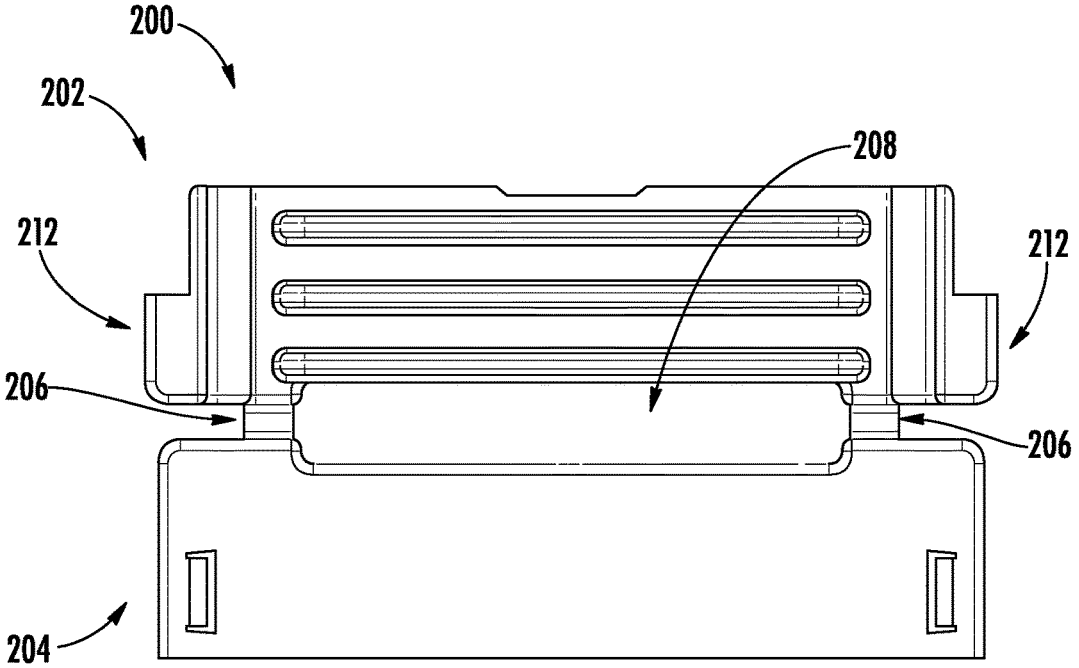
FIG. 3 is a bottom view of the retention clip of FIGS. 2A-2B according to an example embodiment.

With reference to FIGS. 2A, 2B, and 3, an example retention clip 200 of the present disclosure is illustrated. As shown, the retention clip 200 includes a top support member 202, a bottom support member 204, and a hinge element 206 attached to the top support member 202 and the bottom support member 204. The top support member 202 and the bottom support member 204 may define substantially rectangular elements that, via the hinge element 206, are attached to one another. The retention clip 200 may further include an opening 208 that is configured to receive a cable connection therethrough (e.g., a cable connection 104 for engaging a connector 102 of the PCB 100). In some embodiments, the opening 208 may be formed between the top support member 202, the bottom support member 204, and the hinge element 206, as shown. The present disclosure contemplates that the opening 208 may be dimensioned (e.g., sized and shaped) so as to accommodate cable connections of various types or sizes.

Figure 4:
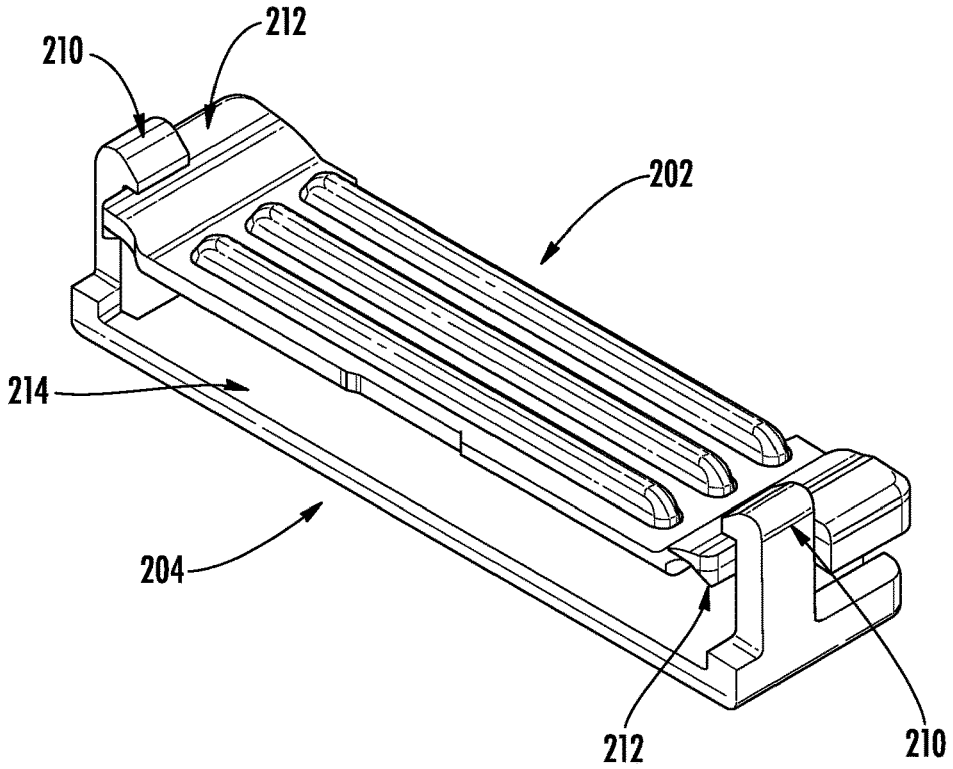
FIG. 4 is a perspective view of the retention clip of FIGS. 2A-3 in a locked position according to an example embodiment.
Figure 5:
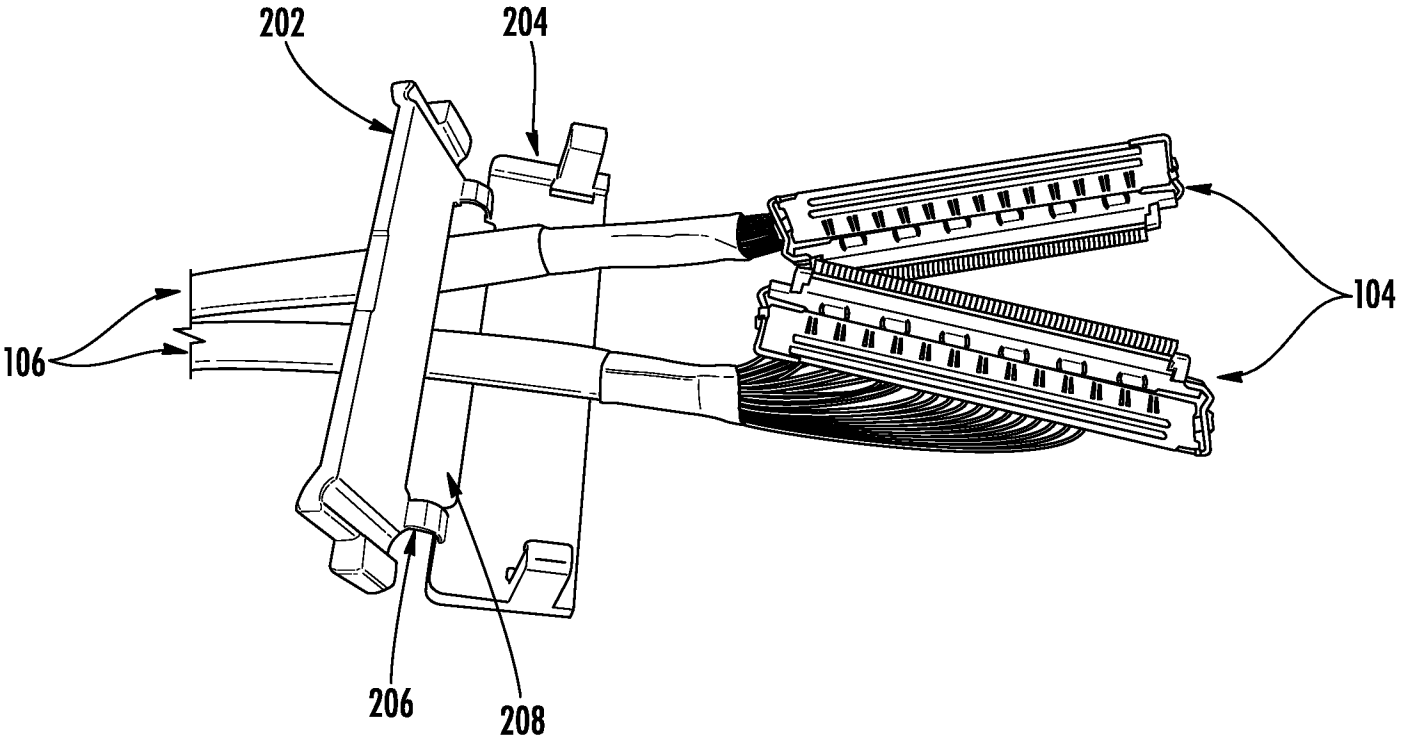
FIG. 5 is a side view of an example retention clip and associated opening receiving one or more cable connections according to an example embodiment.

The hinge element 206 may be configured to allow movement of the retention clip 200 between an unlocked position (e.g., shown in FIGS. 2A-3) and a locked position (e.g., shown in FIG. 4). In FIGS. 2A-3, the retention clip 200 is illustrated in an unlocked position such that the retention clip 200 is removable from the PCB 100 and cable connection 104 of FIGS. 1A-1C. As shown in FIG. 5, in the unlocked position, the retention clip 200 may receive one or more cable connections 104 via the opening 208. The hinge element 206 may, in some embodiments, include two (2) flexible members connecting the top support member 202 and the bottom support member 204 at two locations. In such an embodiment, the opening 208 is formed in the space between the two (2) flexible hinge elements 206. While described with reference to flexible hinge elements, the present disclosure contemplates that the hinge element(s) 206 may include any number of elements located at any location between the top support member 202 and the bottom support member 204 so long as the retention clip 200 may be moved about the hinge element(s) 206 between an unlocked position and a locked position.

With reference to FIG. 3, the retention clip 200 is illustrated in an unlocked position such that the opening 208 is clearly shown. In the unlocked position of FIG. 3, the top support member 202 and the bottom support member 204 are complimentary in shape (notwithstanding the snap tabs 210 and corresponding notch features 212 described hereafter). While the unlocked position is illustrated in FIG. 3 as the full extension of the top support member 202 and the bottom support member 204 (e.g., where the top support member and the bottom support member are positioned in the same plane), the present disclosure contemplates that the unlocked position may refer to any position of the retention clip 200 in which the top support member 202 and/or bottom support member 204 are not engaged with one another, thereby allowing a cable connection 104 to be moved into or out of the opening 208.

In order for the top support member 202 and the bottom support member 204 to engage with one another in the locked position, the bottom support member 204 may define one or more snap tabs 210 extending from a first surface 214 of the bottom support member 204. In some embodiments, the one or more snap tabs 210 may be positioned substantially perpendicular with respect to the bottom support member 204 (e.g., they may extend in a direction of the top support member 202 in the locked position). Similarly, the top support member 202 may define one or more corresponding notch features 212 configured to, in the locked position, receive the one or more snap tabs 210 of the bottom support member 204.

With reference to FIG. 4, the retention clip 200 is illustrated in the locked position in which the snap tabs 210 of the bottom support member 204 are engaged with the notch features 212 of the top support member 202. As shown, the snap tabs 210 may define hook shaped ends that, in the locked position, extend beyond the top support member 202. These hooked ends may extend at least partially over the notch features 210 of the top support member 202 so as to limit the rotation of the top support member 202 and the bottom support member 204 about the hinge element 206. In order to engage the snap tabs 210 and prevent the retention clip 200 from returning to an unlocked position, the notch features 212 may define a ridged edge of the top support member 202 that engages (e.g., connects with, links to, or otherwise contacts) the snap tabs 210.

Furthermore, to promote the engagement of the snap tabs 210 with the notch features 212, in some embodiments, the hinge element 206 may be biased towards the unlocked position (e.g., shown in FIGS. 2A-3). When the retention clip 200 is located in the locked position, the hinge element 206 may urge the top support member 202 and the bottom support member 204 away from one another (e.g., urging movement in opposite directions about the hinge element 206) so as to promote contact between the notch features 212 and the snap tabs 210. This biasing feature may be provided via material selection (e.g., selection of an elastic or flexible material configured to return to a predefined unlocked position), via inclusion of separate spring-loaded features (not shown), or any other biasing mechanism.

Figure 6:
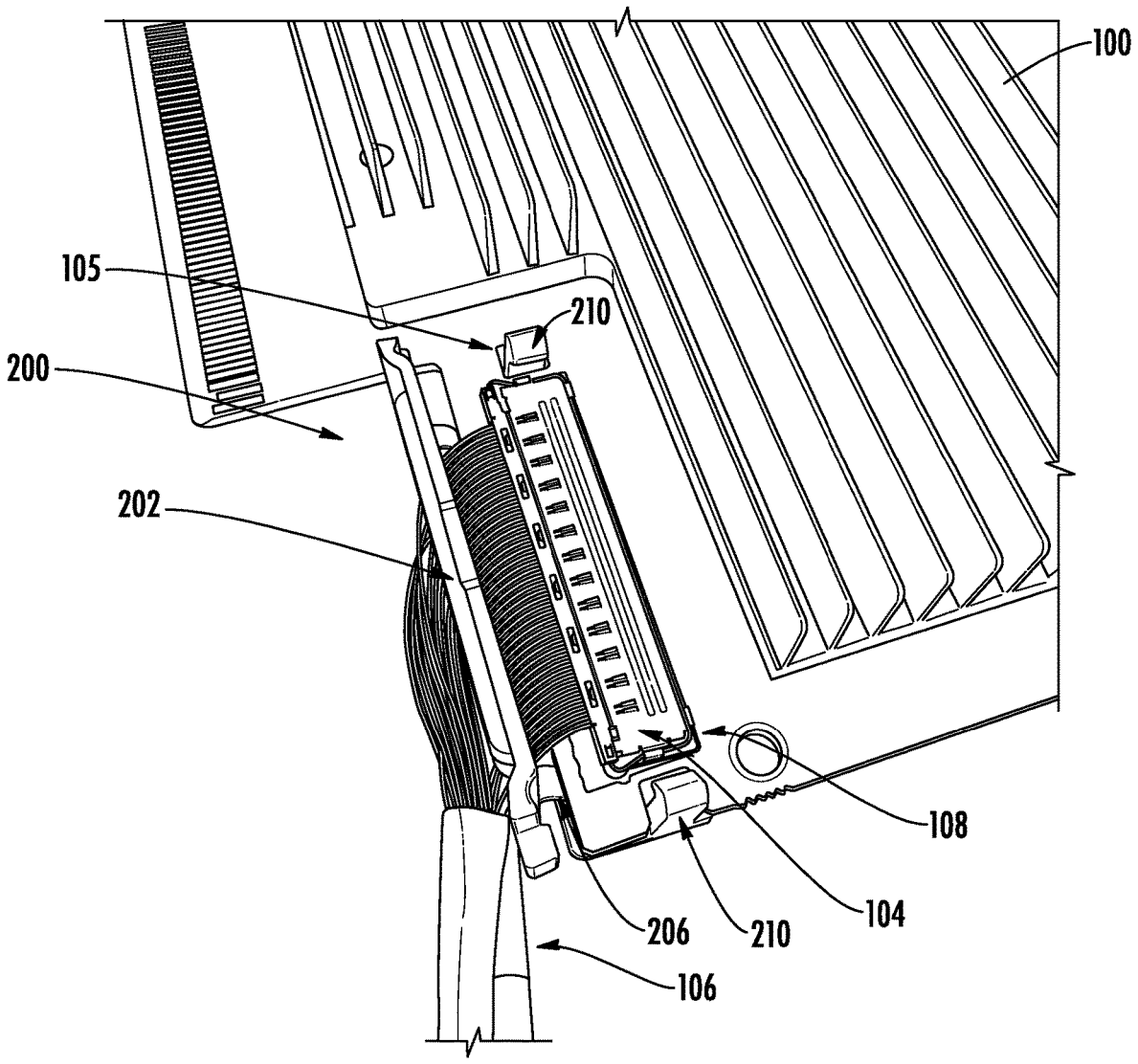
FIG. 6 is a side perspective view of an example retention clip in an unlocked position in conjunction with a cable connection and PCB according to an example embodiment.
Figure 7:
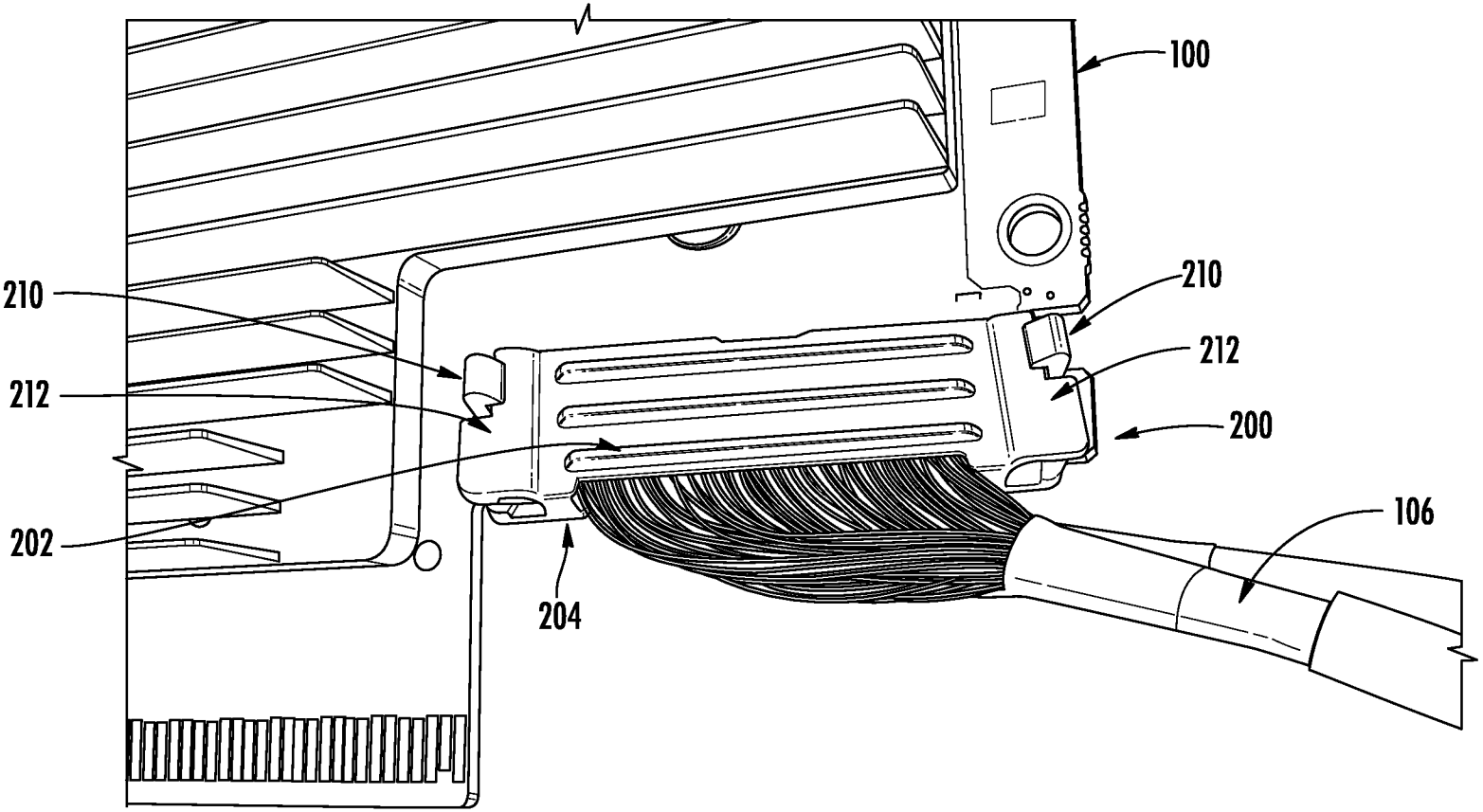
FIG. 7 is a perspective view of the retention clip of FIG. 7 in a locked position securing the cable connection to the PCB according to an example embodiment.

With reference to FIGS. 5-7, stages of installing the retention clip 200 are illustrated with FIGS. 5-6 showing the retention clip in unlocked positions and FIG. 7 showing the retention clip in a locked position. As shown in FIG. 5, the retention clip 200 may be configured to receive one or more cable connections 104 via the opening 208. These cable connections 104 extend through the opening 208 so as to engage corresponding connectors of the PCB as shown in FIG. 6. With reference to FIG. 6, the cable connections 104 are engaged with the connectors 102 of the PCB 100. As described above with reference to FIGS. 1A-1C, the first end 107 of the cable connection 104 may engage with the connector 102 so as to allow data to pass therebetween. Furthermore, in some embodiments in which the cable connection 104 includes a lever arm 108, the lever arm may be folded in the direction of the PCB 100 and located adjacent the connector 102 and the PCB 100, as shown in FIG. 6. The snap tabs 210 of the bottom support member 204 are inserted into the corresponding cut-outs 105 of the PCB 100. These cut-outs 105 operate to allow the retention clip 200 to be secured (over the cable connections 104) to the PCB 100.

With continued reference to FIG. 7, the top support member 202 is folded about the hinge element 206 such that the retention clip 200 is moved to the locked position. As shown, the snap tabs 210 of the bottom support member 204 engage the notch features 212 of the top support member 202. In this way, a first surface of the top support member 202 (e.g., first surface 216 in FIG. 2A) is located proximate the top surface 101 of the PCB 100. Similarly, a first surface of the bottom support member 204 (e.g., first surface 214 in FIG. 2A) is located proximate the bottom surface 103 of the PCB 100. This engagement of the notch features 212 and the snap tabs 210 operates to secure the cable connection 104 with the connector 102 of the PCB, such as by sandwiching the cable connection 104 between the top support member 202 and the bottom support member 204. As is evident by the two (2) cable connections in FIG. 5, in some embodiments, the opening 208 may be further configured to receive two cable connections 104 such that, in the locked position, a first cable connection is attached to a corresponding first connector 102 supported by a top surface 101 of the PCB 100 and a second cable connection is attached to a corresponding second connector (not shown) supported by a bottom surface 103 of the PCB 100. Therefore, the retention clip 200 may operate to simultaneously secure two (2) cable connections 104 with the PCB 100.

As would be evident to one of ordinary skill in the art in light of the present disclosure, the retention clip 200 may transition from the locked position to the unlocked position by disengaging the snap tabs 210 from the notch features 212, such as by moving the snap tabs 210 outward with respect to the bottom support member 204. The top support member 202 and the bottom support member 204 may then fold about the hinge element 206 to return to an unlocked position. Thereafter, the cable connection(s) 104 may be removed from the connector(s) 102 of the PCB 100 and withdrawn from the opening 208. While the retention clip 200 is illustrated herein as a single, integral body, the present disclosure contemplates that embodiments of the retention clip 200 may also be formed as separate, distinct elements (e.g., modular components). Furthermore, the retention clip 200 may be formed by any process known in the art such as by additive manufacturing (e.g., 3D printing), injection molding, machining, or the like without limitation.

Example Method of Manufacture

Figure 8:
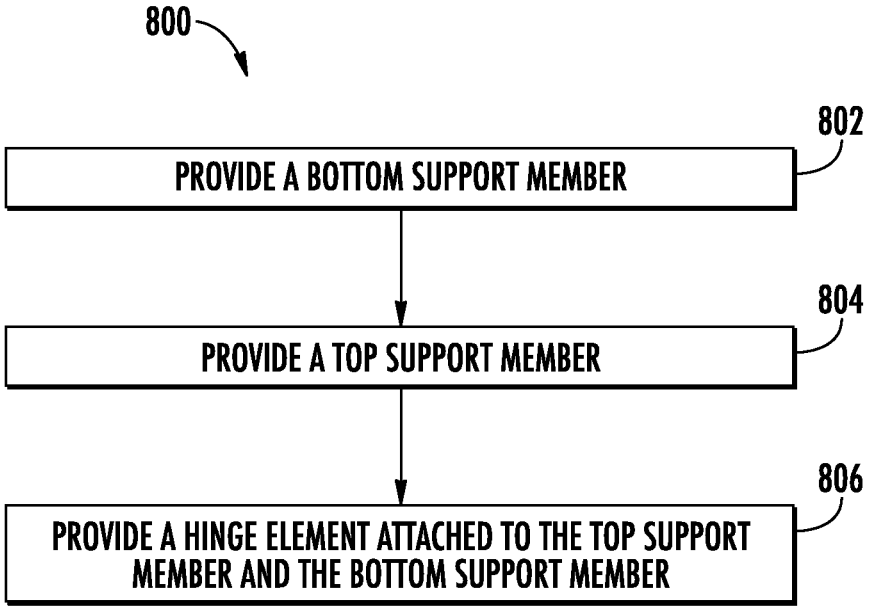
FIG. 8 is a flowchart depicting a method of manufacturing a retention clip according to an example embodiment.

With reference to FIG. 8, a method of manufacturing a retention clip configured to secure a cable connection to a printed circuit board (PCB) according to embodiments of the invention is illustrated. The method (e.g., method 800) may include the step of providing a bottom support member at Block 802 and providing a top support member at Block 804. As described above, the top support member and the bottom support member may be complimentary in shape such that in an unlocked position the top support member and the bottom support member may be positioned in the same plane. In some embodiments, providing the bottom support member may further include providing one or more snap tabs extending from a first surface of the bottom support member. In some embodiments, the one or more snap tabs may be positioned substantially perpendicular with respect to the bottom support member. Similarly, in some embodiments, providing the top support member may further include providing one or more corresponding notch features configured to, in the locked position, receive the one or more snap tabs of the bottom support member.

The method 800 may also include providing a hinge element attached to the top support member and the bottom support member at Block 806. As described above, the hinge element may be configured to allow movement of the retention clip between an unlocked position and a locked position. The hinge element may, in some embodiments, include two (2) flexible members connecting the top support member and the bottom support member at two locations. In such an embodiment, providing the hinge element(s) may form an opening in the space between the two (2) flexible hinge elements. While described with reference to flexible hinge elements, the present disclosure contemplates that providing the hinge element(s) may include providing any number of elements located at any location between the top support member and the bottom support member so long as the retention clip may be moved about the hinge element(s) between an unlocked position and a locked position.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A retention clip configured to secure a cable connection to a printed circuit board (PCB), the retention clip comprising:

a bottom support member;

a top support member; and a pair of hinge elements attached to the top support member and the bottom support member, wherein the pair of hinge elements is configured to allow movement of the retention clip between a locked position and an unlocked position, wherein the retention clip defines an opening between the hinge elements configured to receive two cable connections therethrough, and wherein, in the locked position, the top support member is configured to be folded about the pair of hinge element so as to engage the bottom support member and secure a first cable connection to a corresponding first connector supported by a top surface of the PCB and a second cable connection to a corresponding second connector supported by a bottom surface of the PCB.

2. The retention clip according to claim 1, wherein the bottom support member further defines one or more snap tabs extending from a first surface of the bottom support member.

3. The retention clip according to claim 2, wherein the one or more snap tabs extend substantially perpendicular with respect to the bottom support member.

4. The retention clip according to claim 2, wherein, in the locked position, the first surface of the bottom support member is configured to be located proximate the corresponding bottom surface of the PCB.

5. The retention clip according to claim 2, wherein, in the locked position, the one or more snap tabs are configured to be received by one or more corresponding cut-outs of the PCB.

6. The retention clip according to claim 2, wherein the top support member further defines one or more corresponding notch features configured to, in the locked position, receive the one or more snap tabs of the bottom support member engaged therewith.

7. The retention clip according to claim 1, wherein, in the locked position, a first surface of the top support member is configured to be located proximate the corresponding top surface of the PCB.

8. The retention clip according to claim 1, wherein the pair of hinge elements is biased towards the unlocked position.

9. A method of manufacturing a retention clip configured to secure a cable connection to a printed circuit board (PCB), the method comprising:

providing a bottom support member;

providing a top support member; and providing a pair of hinge elements attached to the top support member and the bottom support member, wherein the pair of hinge elements is configured to allow movement of the retention clip between a locked position and an unlocked position, wherein the retention clip defines an opening between the hinge elements configured to receive two cable connection therethrough, and wherein, in the locked position, the top support member is configured to be folded about the pair of hinge elements so as to engage the bottom support member and secure a first cable connection to a corresponding first connector supported by a top surface of the PCB and a second cable connection to a corresponding second connector supported by a bottom surface of the PCB.

10. The method according to claim 9, wherein providing the bottom support member further comprises defining one or more snap tabs extending from a first surface of the bottom support member.

11. The method according to claim 10, wherein the one or more snap tabs extend substantially perpendicular with respect to the bottom support member.

12. The method according to claim 10, wherein, in the locked position, the first surface of the bottom support member is configured to be located proximate the corresponding bottom surface of the PCB.

13. The method according to claim 10, wherein, in the locked position, the one or more snap tabs are configured to be received by one or more corresponding cut-outs of the PCB.

14. The method according to claim 10, wherein providing the top support member further comprises defining one or more corresponding notch features configured to, in the locked position, receive the one or more snap tabs of the bottom support member engaged therewith.

15. The method according to claim 9, wherein, in the locked position, a first surface of the top support member is configured to be located proximate the corresponding top surface of the PCB.

16. The method according to claim 10, wherein the pair of hinge elements is biased towards the unlocked position.

17. A cable connection retention system, the system comprising:

a printed circuit board (PCB), the PCB comprising:

at least one connector configured to receive a cable connection attached thereto; and one or more cut-outs; and a retention clip comprising:

a bottom support member;

a top support member; and a pair of hinge elements attached to the top support member and the bottom support member, wherein the pair of hinge elements is configured to allow movement of the retention clip between a locked position and an unlocked position, wherein the retention clip defines an opening between the hinge elements configured to receive two cable connections therethrough, and wherein, in the locked position, the top support member is configured to be folded about the pair of hinge elements so as to engage the bottom support member through the one or more cut-outs of the PCB to secure a first cable connection to a corresponding first connector supported by a top surface of the PCB and a second cable connection to a corresponding second connector supported by a bottom surface of the PCB.

18. The cable connection retention system according to claim 17, wherein, in the locked position, a first surface of the top support member is configured to be located proximate the corresponding top surface of the PCB.

19. The cable connection retention system according to claim 17, wherein the pair of hinge elements is biased towards the unlocked position.

20. The cable connection retention system according to claim 17, wherein the bottom support member further defines one or more snap tabs extending from a first surface of the bottom support member.

* * * * *